US011355279B2

(12) United States Patent
Liang et al.

(10) Patent No.: US 11,355,279 B2
(45) Date of Patent: Jun. 7, 2022

(54) CORE SEALING ASSEMBLIES, CORE-COIL ASSEMBLIES, AND SEALING METHODS

(71) Applicants: Siemens Energy Global GmbH & Co. KG, Munich (DE); Hainan Jinpan Smart Technology Co. Ltd, Hainan (CN)

(72) Inventors: Haoning Liang, Beijing (CN); Martin Alsina Navarro, Sao Paulo (BR); Andre Luiz Moreno, Varzea Paulista (BR); Rongwang Wang, Hainan (CN); Xiong Li, Hainan (CN)

(73) Assignees: SIEMENS ENERGY GLOBAL GMBH & CO. KG, Munich (DE); HAINAN JINPAN SMART TECHNOLOGY CO. LTD, Haikou (CN)

( * ) Notice: Subject to any disclaimer, the term of this patent is extended or adjusted under 35 U.S.C. 154(b) by 0 days.

(21) Appl. No.: 15/734,191

(22) PCT Filed: Jun. 7, 2018

(86) PCT No.: PCT/CN2018/090316

§ 371 (c)(1),
(2) Date: Dec. 1, 2020

(87) PCT Pub. No.: WO2019/232762

PCT Pub. Date: Dec. 12, 2019

(65) Prior Publication Data

US 2021/0166865 A1 Jun. 3, 2021

(51) Int. Cl.
*H01F 30/12* (2006.01)
*H01F 27/32* (2006.01)
(Continued)

(52) U.S. Cl.
CPC ..... *H01F 27/327* (2013.01); *H01F 27/306* (2013.01); *H01F 41/122* (2013.01); *H01F 2027/328* (2013.01)

(58) Field of Classification Search
CPC ..... H01F 27/306; H01F 27/327
(Continued)

(56) References Cited

U.S. PATENT DOCUMENTS 3,657,808 A 4/1972 Zickar et al.
3,720,897 A 3/1973 Feather et al.
(Continued)

FOREIGN PATENT DOCUMENTS

CN 202632987 U 12/2012
CN 205452021 U 8/2016
(Continued)

OTHER PUBLICATIONS

Enlgish translation of GB-1452766-A (Year: 1976).*
(Continued)

*Primary Examiner* — Ronald Hinson

(57) ABSTRACT

A sealed core-coil assembly in a submersible transformer includes a coil assembly having an inner coil with inner, outer, upper, and lower surfaces, and an outer coil with inner, outer, upper, and lower surfaces, a core assembly including a core window and core column of a magnetically-permeable material, the core column and core window having inner side surfaces, and an expandable sealing member including an inner cavity that is fillable or evacuatable so that a compliant insulation material is positioned in the inner cavity to block passage of water and prevent the formation of a loop of water, which otherwise would act like an electrical short in a submerged transformer.

18 Claims, 12 Drawing Sheets

(51) Int. Cl.
*H01F 27/30* (2006.01)
*H01F 41/12* (2006.01)

(58) Field of Classification Search
USPC ..... 336/5
See application file for complete search history.

(56) References Cited

U.S. PATENT DOCUMENTS

| | | | | |
|---|---|---|---|---|
| 3,783,426 | A | 1/1974 | Morris, Jr. et al. | |
| 4,447,796 | A * | 5/1984 | Heinrichs | H01F 27/322 174/17 SF |
| 2013/0293329 | A1 | 11/2013 | Weber et al. | |
| 2014/0028427 | A1 * | 1/2014 | Navarro | H01F 27/16 336/61 |
| 2016/0132272 | A1 | 5/2016 | Iwashita | |

FOREIGN PATENT DOCUMENTS

| | | | | |
|---|---|---|---|---|
| EP | 0964412 | A1 | 12/1999 | |
| EP | 3331132 | A1 | 6/2018 | |
| GB | 1452766 | A * | 10/1976 | H01G 4/22 |
| JP | S59219916 | A | 12/1984 | |

OTHER PUBLICATIONS

International Search Report and Written Opinion dated Feb. 27, 2019 corresponding to PCT Application PCT/CN2018/090316 filed Jun. 7, 2018.

* cited by examiner

CORE SEALING ASSEMBLIES, CORE-COIL ASSEMBLIES, AND SEALING METHODS

FIELD

This application relates to transformers used for electric power distribution, and more particularly to apparatus, assemblies, and methods for sealing between components in dry-type transformers.

BACKGROUND

Transformers are employed to increase or decrease voltage levels during electrical power distribution. To transmit electrical power over a long distance, a transformer may be used to raise the voltage and reduce the current of the power being transmitted. A reduced current level reduces resistive power losses from the electrical cables used to transmit the power. When the power is to be consumed, a transformer may be employed to reduce the voltage level, and increase the current, of the power to a level specified by the end user.

One type of transformer that may be employed is a dry, submersible transformer, as described, for example, in U.S. Pat. No. 8,614,614, the disclosure of which is hereby incorporated by reference for all purposes herein. Such transformers may be employed underground, in cities, etc., and may be designed to withstand harsh environments such as water exposure, humidity, pollution, and the like. Improved apparatus, assemblies, and methods for submersible and other dry-type transformers are desired.

SUMMARY

In some embodiments, a core-coil assembly of a dry-type transformer is provided. The core-coil assembly includes a coil assembly having an inner coil with an inner surface, an outer surface, an upper surface, and a lower surface, and an outer coil with an inner surface, an outer surface, an upper surface, and a lower surface; a core assembly including a core window and a core column of a magnetically-permeable material, the core column and the core window having inner side surfaces; and an expandable sealing member including an inner cavity that is fillable or evacuatable provided between:

one or more inner side surfaces of the core column and an inner surface of the inner coil, the outer surface of the inner coil and the inner surface of the outer coil, and between the upper surface and lower surface of the inner coil and the outer coil and the inner side surfaces of the core window.

In some embodiments, a core-coil assembly is provided. The core-coil assembly includes a coil assembly including multiple coils, each of the multiple coils having outer peripheral surfaces; a core assembly including a core window and at least one core column of a magnetically-permeable material, the core window having inner side surfaces; and expandable sealing members each including an inner cavity that is fillable or evacuatable inserted between the outer peripheral surfaces of the multiple coils within the core window and between the multiple coils and the inner side surfaces of the core window.

In some embodiments, a core-coil assembly is provided. The core-coil assembly includes a core assembly of a magnetically-permeable material having a core window with an inner side surface; a coil assembly, a portion of which resides in the core window, the coil assembly including an end surface; and an expandable sealing member provided between the inner side surface of the core window and the end surface of the coil assembly, the expandable sealing member including an inner cavity.

In further embodiments, a method of sealing a core-coil assembly is provided. The method includes providing a core assembly having a core window; providing a coil assembly, a portion of which, resides in the core window; providing expandable sealing member including an inner cavity in a gap in the core window that is unoccupied by the coil assembly; and increasing the volume of the inner cavity to expand an outside dimension of the sealing member to seal the gap.

Still other aspects, features, and advantages of this disclosure may be readily apparent from the following detailed description illustrated by a number of example embodiments and implementations. This disclosure may also be capable of other and different embodiments, and its several details may be modified in various respects. Accordingly, the drawings and descriptions are to be regarded as illustrative in nature, and not as restrictive.

BRIEF DESCRIPTION OF THE DRAWINGS

The drawings, described below, are for illustrative purposes only and are not necessarily drawn to scale. The drawings are not intended to limit the scope of the invention in any way. Wherever possible, the same or like reference numbers are used throughout the drawings to refer to the same or like parts.

DETAILED DESCRIPTION

Figure 1:
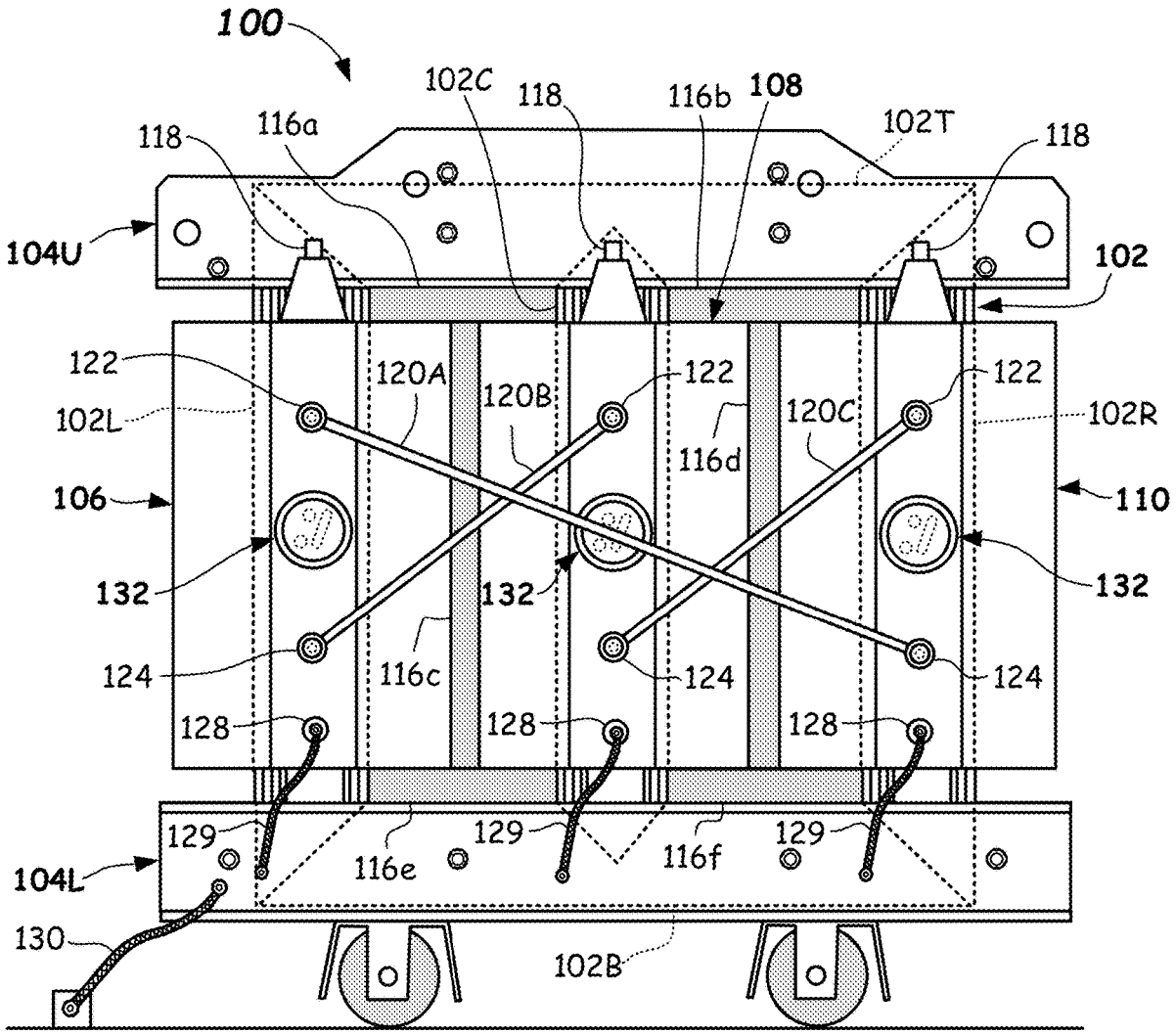
FIG. 1 illustrates a side plan view of a submersible dry-type transformer including multiple core-coil assemblies in accordance with one or more embodiments provided herein.

As mentioned above, submersible dry-type transformers may be employed underground and/or in other environments that may expose the transformers to water, humidity, pollutants, etc. Such transformers are often connected to deliver multiple phases of electrical power, such as 2-phase or 3-phase electrical power. Common 3-phase configurations include, for example, delta and wye connected transformer assemblies.

In accordance with one or more embodiments described herein, submersible dry-type transformers, core-coil assemblies, and methods of sealing core-coils assemblies are provided that offer improved manufacturing time. In the prior art, foam strip elements are used to seal between the core window and the outer parts of the low-voltage inner coil and the outer parts of the high-voltage outer coil of the coil assembly, and also between the low-voltage inner coil and the high-voltage outer coil. These foam strips are compressed during installation, for example where the low-voltage inner coil is inserted over the core column with the foam strips in place. Of course, in order to retain the proper seal, the thickness of the foam strip is slightly thicker than the gap it seals. As such, insertion of the low-voltage inner coil over the core column during the assembly method of the core-coil assembly can be quite difficult and can take relatively large forces to accomplish. Moreover, it may be difficult to keep the foam strip elements in place during assembly thereof, i.e., they tend to slide along with the low-voltage inner coil. Likewise, sealing between the low-voltage inner coil and the high-voltage outer coil can have the same problems of high forces to insert the high-voltage outer coil over the low-voltage inner coil and with keeping the seal properly positioned. Similar problems can be encountered sealing the core window above and below the coil assembly.

Thus, in accordance with one or more embodiments of the disclosure, methods and apparatus are provided that can improve ease of assembly of the core-coil assembly and of the sealing elements and/or the effectiveness of the sealing of the core window.

In some embodiments, a core-coil assembly of a dry-type transformer is provided. In some embodiments, the core-coil assembly comprises an expandable sealing member including an inner cavity that is fillable or evacuatable or both. The fillable or evacuatable sealing member seals the core window, and in particular, between one or more side surfaces of a core column and an inner side surface of the low-voltage inner coil, between the outer surface of the low-voltage inner coil and the inner surface of the high-voltage outer coil, and between a top and bottom of the coil assembly and the inside surface of the core window.

The expandable sealing member that includes an inner cavity that is fillable or evacuatable is configured so that it can have a dimension that is less than the gap it will fill initially and then can be expanded to fill the gap dimension between the components being sealed. In some embodiments, the cavity of the expandable sealing member is filled with a material (e.g., silicone under pressure) in order to expand the expandable sealing member to fill the gap. Once filled, the filler material can be cured in place. In other embodiments, a vacuum can be applied to the cavity of the expandable sealing member to contract/flex at least some portions of the expandable sealing member to produce a dimension that is less than the gap. The vacuum can then be released to allow the expandable sealing member to seal the gap. This can further be followed by optional filling the cavity with a suitable material. Because the expandable sealing member has a dimension less than the gap dimension, no force against the sealing member is needed to assemble the various units (low-voltage inner coil to core column, high-voltage outer coil to low-voltage inner coil, and coil assembly to core window). The expandable sealing member can be position easily during the assembly methods and precisely positioned.

These and other embodiments of expandable sealing members including a cavity, sealing apparatus, core-coil assemblies, and dry-type transformers including expandable sealing members are described herein with reference to FIGS. 1-10 herein.

FIG. 1 is a front plan view of a dry-type transformer 100 in accordance with embodiments provided herein. The dry-type transformer 100 shown is a three-phase transformer, but in other embodiments, transformers with different number of phases may be employed (e.g., one or two phases). Dry-type transformer as used herein means a transformer that includes high-voltage and low-voltage coils that are not submerged in an oil bath contained within an enclosure. Such dry-type transformers 100 have significant advantages, in that they do not utilize oil that could escape the enclosure and cause contamination or possibly ignite during an extreme event. Moreover, the coils are exposed directly to the environment such that the can run cooler via cooling by air or water (when submerged).

By way of example, the dry-type transformer 100 can include a core assembly 102 mounted between an upper frame portion 104U and lower frame portion 104L. Insulating sheets (not shown) may be provided to insulate the front and back sides of the core assembly 102 from the respective front and back portions of the upper frame 104U and lower frame 104L. Core assembly 102 may be made up of multiple laminations of a magnetic material. Example magnetic materials include magnetically-permeable materials such as iron, steel, amorphous steel or other amorphous magnetically permeable metals, silicon-steel alloy, carbonyl iron, ferrite ceramics, and more particularly laminated layers of one or more of the above materials, and the like. In some embodiments, laminated ferromagnetic metal materials having high cobalt content can be used. Other suitable magnet metals and magnetically-permeable materials can be used.

As shown in FIG. 1 and FIG. 3A-3C, core assembly 102 can include multiple interconnected pieces, which can include, one or more core columns and in the depicted embodiment, vertical core columns 102L, 102C, and 102R. Vertical core columns 102L, 102C, and 102R can be assembled with top and bottom core legs 102T, 102B to form the core assembly 102. Construction may include step-laps between respective components of the core assembly 102. Construction of the core assembly 102 can be as is shown in U.S. Pat. No. 4,200,854 or 8,212,645, for example. Other lapping configurations of the core assembly 102 or even wound core configurations could be used. When assembled, bolted together and painted, the core assembly 102 can include, as shown, two core windows 102W.

Each core window 102W includes, and is defined by, side surfaces 102S. Two core windows 102W are shown in the depicted embodiment. However, it should be recognized that the described methods and apparatus herein are applicable to core assemblies with only one core window and including two core columns wherein one or two coil assemblies are provided over respective core columns thereof. Further, in the depicted embodiments, the core columns 102L, 102C, 102R are shown as vertically oriented. However, other orientations are possible.

In some embodiments, within dry-type transformer 100, each core column 102L, 102C, and 102R can be surrounded by a coil assembly, namely coil assemblies 106, 108, 110. An example core assembly is shown in FIG. 2A.

Figure 2A:
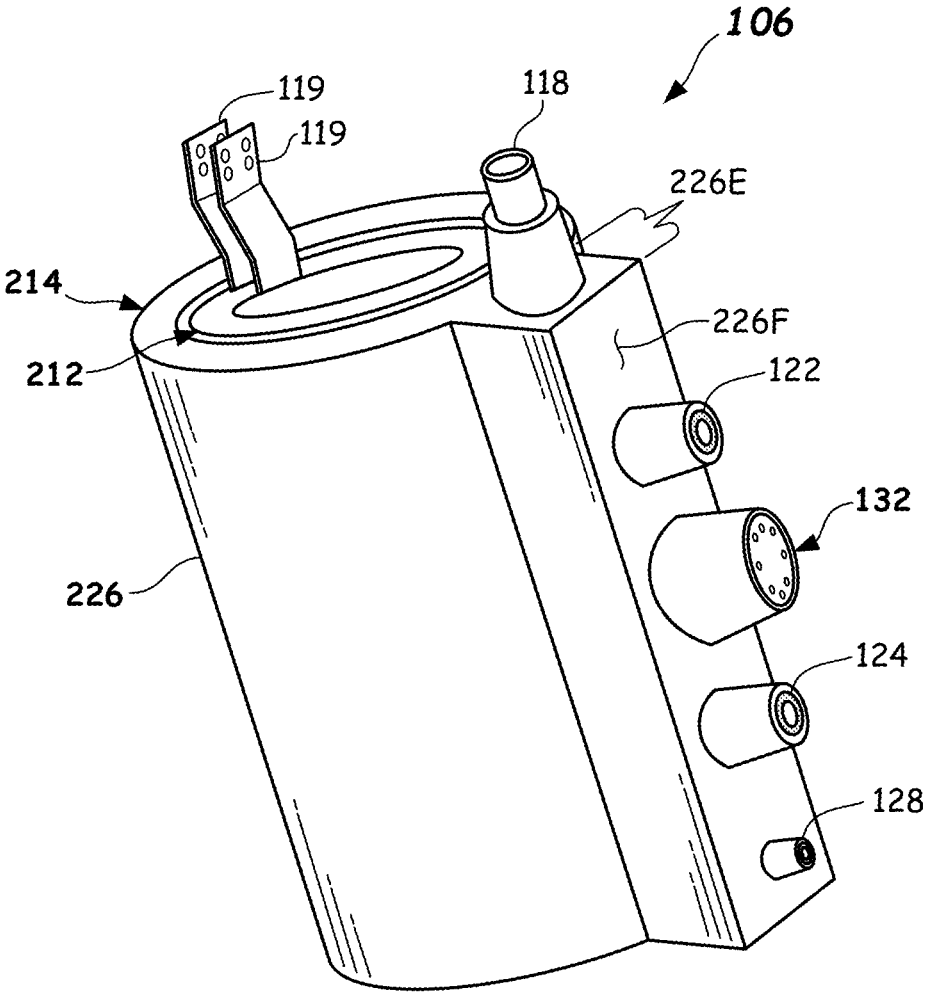
FIG. 2A illustrates a perspective view of a coil assembly including inner and outer coils in accordance with one or more embodiments provided herein.
Figures 2B, 2C:
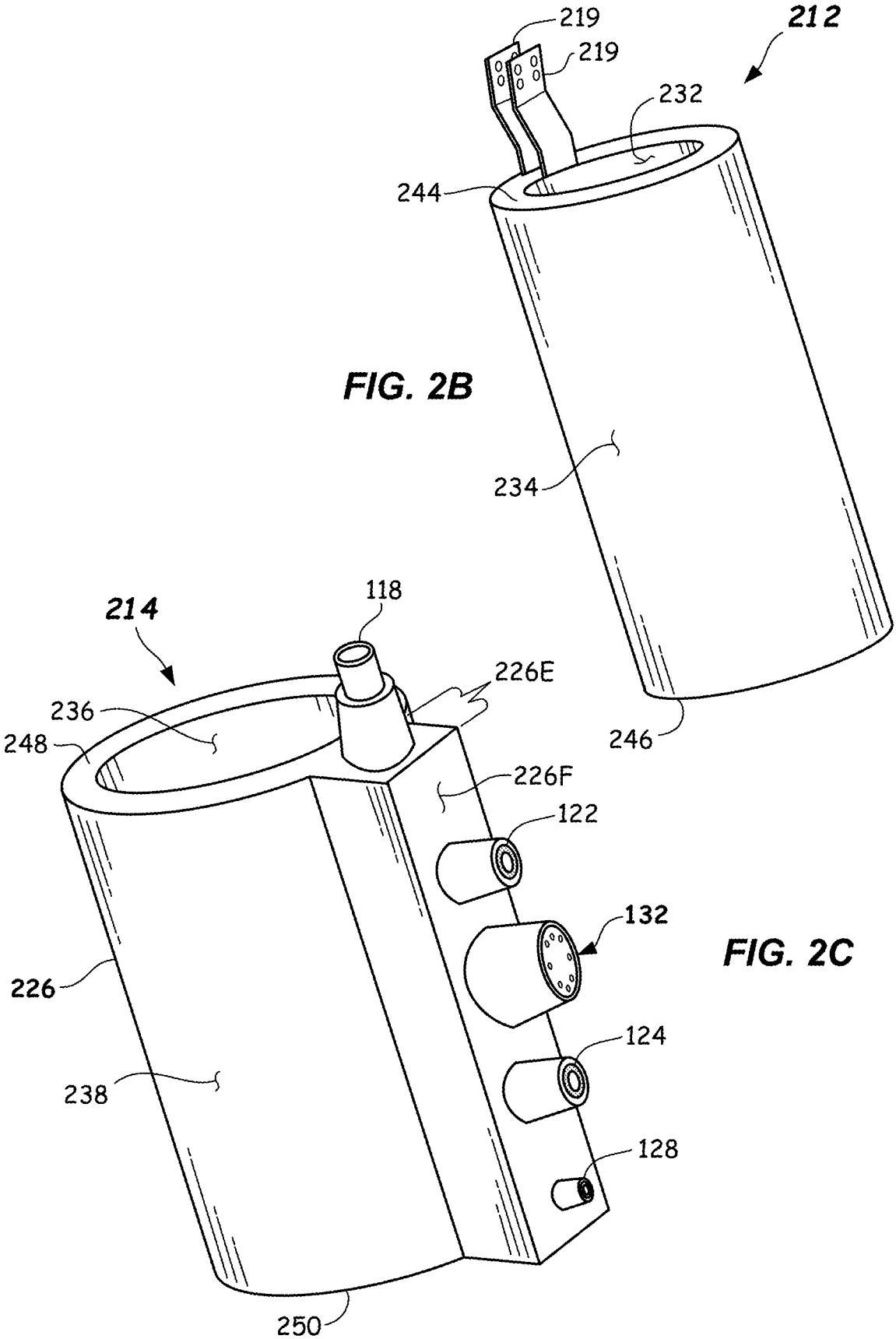
FIG. 2B illustrates a perspective view of an inner coil of the coil assembly in accordance with one or more embodiments provided herein.
FIG. 2C illustrates a perspective view of an outer coil of the coil assembly in accordance with one or more embodiments provided herein.

FIG. 2A illustrates a perspective view of an example coil assembly 106. Coil assembly 106 is shown and described herein by way of example, and coil assemblies 108, 110 can be identical or substantially identical thereto. As best shown in FIGS. 2B-2C, the coil assembly 106 includes a low-voltage inner coil 112 and a high-voltage outer coil 114, which may be concentric when installed with the low-voltage inner coil 112. Low-voltage inner coil 112 may be electrically isolated from the core assembly 102 and also from the high-voltage outer coil 114. For example, low-voltage inner coil 112 may be surrounded by an insulating material such as a molded resin. Likewise, high-voltage outer coil 114 may be surrounded by an insulating material such as a molded resin. Example insulating materials can include any suitable solid insulation, such as an epoxy, polyurethane, polyester, silicone, and the like.

Figure 3A:
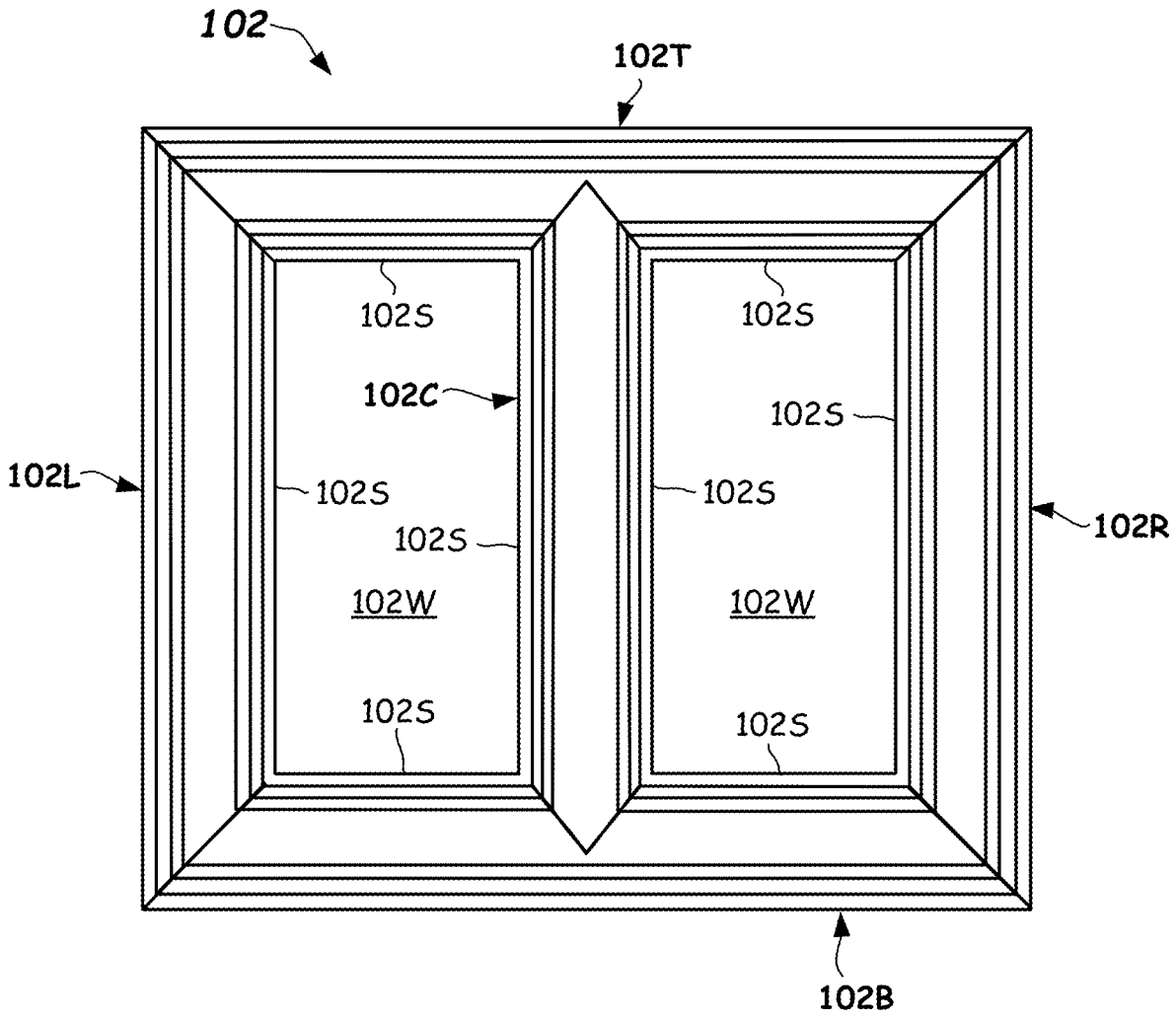
FIG. 3A illustrates a side plan view of an example embodiment of the core assembly in accordance with one or more embodiments provided herein.
Figure 3B:
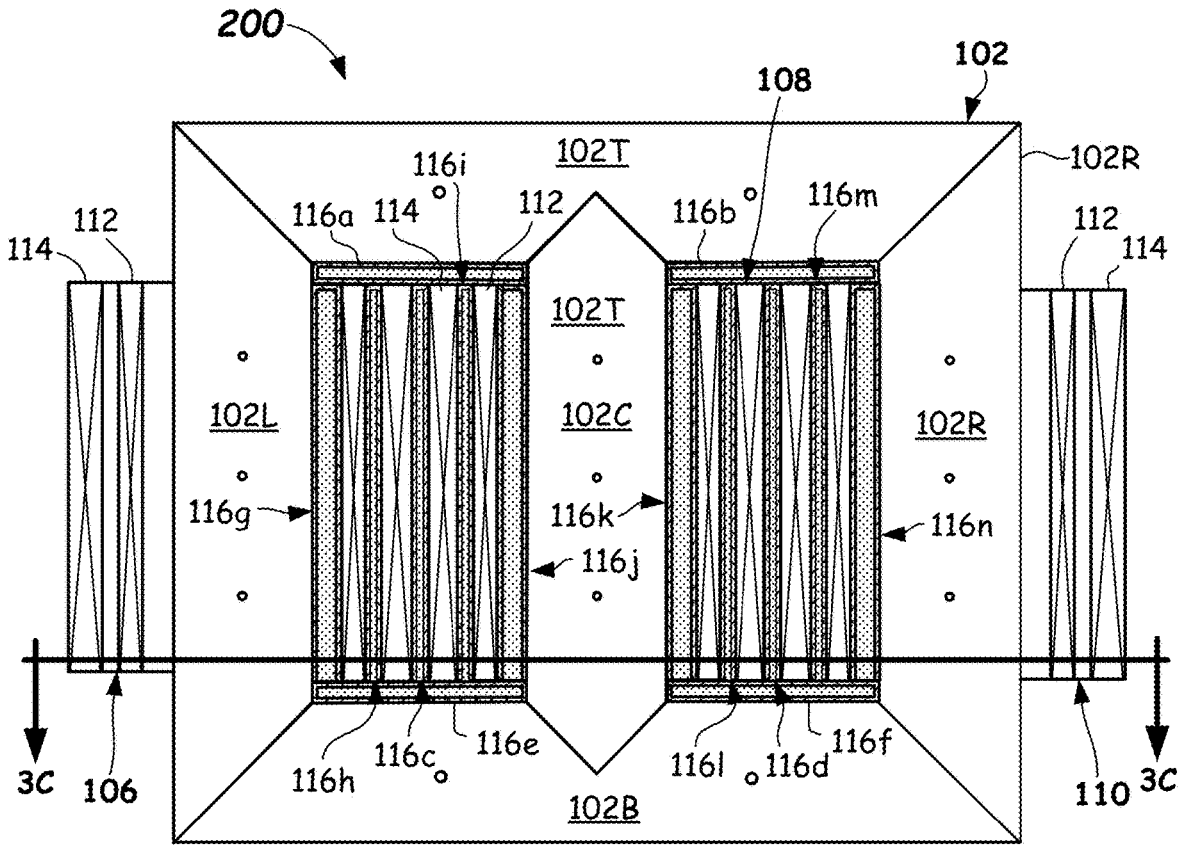
FIG. 3B illustrates a cross-sectioned partial side view of an example embodiment of a core-coil assembly including a core assembly and coil assemblies in accordance with one or more embodiments provided herein.

Referring again to FIG. 1A and also to FIGS. 3A-3B, the coil assemblies 106, 108, 110 and core assembly 102 can be separated by expandable sealing members 116*a*-116*n* wherein at least some, and preferably all include a cavity. Prior art foam sealing sheets are described in U.S. Pat. No. 8,614,614 entitled "Submersible Dry Transformer," the disclosure of which is hereby incorporated by reference for all purposes herein. Expandable sealing members 116*a*-116*n* may be any suitable compliant insulation material including a cavity 440 and collectively operate to seal a plane of the core window 102W of the core assembly 102 that is unoccupied, and thus block passage of water and prevent a loop of water from being formed when a disclosed transformer is submerged; otherwise, the loop of water, being electrically conductive, would result in an electrical short.

Figure 3C:
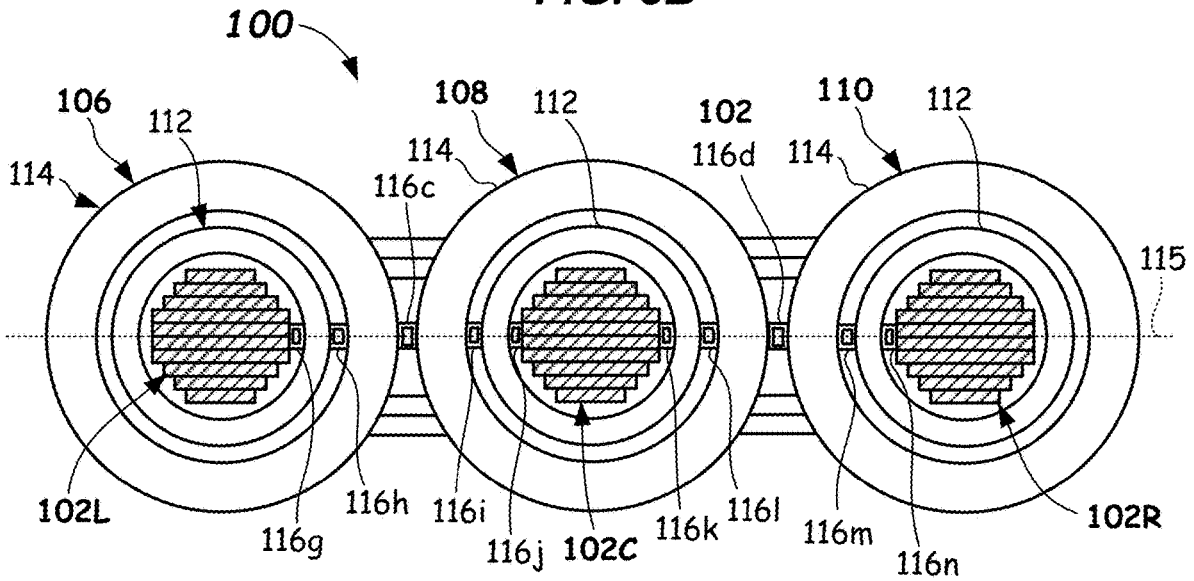
FIG. 3C illustrates a cross-sectioned partial top view of an example embodiment of the core-coil assembly in accordance with one or more embodiments provided herein.

In FIG. 3B-3C, the expandable sealing members 116C-116*d*, 116*g*-116*n* and are shown aligned along a central plane 115 of the window 102W. The other expandable sealing elements 116*a*-116*b* and 116*e*-116*f* can be aligned along the same central plane 115. Such plane-aligned expandable sealing members 116*a*-116*n* are positioned to block passage of water and prevent the formation of a loop of water, which otherwise would act like an electrical short. As shown, expandable sealing elements 116*h*, 116*i*, 116*l*, and 116*m* are included between the low-voltage inner coil 112 and a high-voltage outer coil 114. Expandable sealing elements 116*g*, 116*j*, 116*k*, and 116*n* are included between the low-voltage inner coil 112 and the side surfaces of core columns 102L, 102C, 102R and aligned along the central plane 115. Expandable sealing members 116*c* and 116*d* are included between the high-voltage outer coils 114 and can be aligned along the central plane 115. Likewise, expandable sealing elements 116*a*-116*b* and 116*e*-116*f* are included between the upper surfaces and lower surfaces and the side surfaces 102S of the core window 120W and can be aligned along the central plane 115.

Thus, in one embodiment, a core-coil assembly 200 is provided that includes a core column (e.g., any one of core columns 102L, 102C, 102R), and a first coil (e.g., any one of inner coils 212) received about the respective core column (e.g., any one of core columns 102L, 102C, 102R) and forming a gap there between. Core-coil assembly 200 further includes an expandable sealing member (e.g., any one of expandable sealing members 116*g*, 116*j*, 116*k*, 116*n*) including a cavity 440, sealing the gap between the respective core column and the respective first coil.

The core-coil assembly 200 can further include a second coil (e.g., outer coil 214) surrounding the first coil (e.g., inner coil 212) and providing another gap between the first coil and the second coil, and another expandable sealing member (e.g., one of expandable sealing members 116*h*, 116*i*, 116*l*, and 116*m*) including a cavity 440 sealing the gap between the first coil and the second coil.

In another embodiment, a core-coil assembly 200 configured with sealed ends of a coil assembly is provided (See FIGS. 3A-3C). The core-coil assembly 200 includes a core assembly 102 of a magnetically-permeable material having one or more core windows 102W with inner side surfaces 102S, and a coil assembly (e.g., coil assembly 106, 108, 110) in at least one, and preferably all of the core windows 102W, the coil assembly including end surfaces (e.g., end surfaces 244, 246, 248, 250). The core-coil assembly 200 further includes an expandable sealing member (e.g., expandable sealing member 116*a*, 116*b*, 116*e*, 116*f*) provided between the inner side surface 102S of the core window 102W and the end surfaces 244, 246, 248, 250 of the coil assembly, the expandable sealing member including an inner cavity.

Referring now to FIGS. 1 and 2A-2B, each of the coil assemblies 106, 108, 110 of the transformer 100 can be provided with high voltage terminals 118 that can be positioned at a top front of the respective coil assemblies 106, 108, 110. Low voltage terminals 219 of the low voltage inner coil 212 (FIG. 2B) can be provided on a back side of the coil assemblies 106, 108, 110. For example, as best shown in FIG. 2A, the high voltage terminals 118 can be located on a top front of a columnar front extension 226E of the coil housing 226 comprising insulation around the respective high-voltage outer coil 214. The low voltage terminals 219 can be located on a rear part of the low-voltage inner coil 212. However, the high voltage terminals 118 and low voltage terminals 219 could be located elsewhere. The high voltage terminals 118 provide electrical power connections to the high-voltage outer coils 214 of the respective coil assemblies 106, 108, 110. Connectors (not shown), such as sealed plug-in connectors, may be provided to facilitate sealed connection of high-voltage terminals 118 to electrical cables (not shown). Wye connections (not shown) or the like may be made with low voltage terminals 219. Other suitable sealed electrical connections are possible.

As best shown in FIGS. 1 and 2A-C, the transformer 100 can also include delta connections 120A, 120B, and 120C between the respective high-voltage outer coils 114 of the coil assemblies 106, 108, 110. Delta connections 120A, 120B, 120C may comprise shielded cables, for example. Each of the delta connections 120A, 120B, 120C can be made to an upper delta terminal 122 and a lower delta terminal 124 of the high-voltage outer coil 114 of each of the coil assemblies 106, 108, 110, as shown. The electrical connections can be sealed connections. The upper delta terminal 122 and lower delta terminal 124 can extend horizontally (as shown) from the columnar front extension 226E of the coil housing 226. For example, the upper delta terminal 122 and lower delta terminal 124 can extend outwardly from a front face 226F of the columnar front extension 226E in some embodiments.

The high-voltage outer coil 114 of each of the coil assemblies 106, 108, 110 can include a grounding terminal 128. Grounding conductors 129, such as braided cables can connect between the respective grounding terminals 128 of the high-voltage outer coils 114 and the lower frame 104L, for example. A common grounding strap 130 can attach to the lower frame 104L and can provide an earth ground. Each of the coil assemblies 106, 108, 110 can include a tap changer assembly 132. Tap changer assemblies 132 allows the voltage across the respective the coil assemblies 106, 108, 110 to be adjusted, usually by a +/− voltage about a nominal voltage value by repositioning a moveable bridge element.

Additional details regarding conventional construction of submersible dry-type transformers 100 that may be employed in accordance with one or more embodiments provided herein are described in previously-mentioned U.S. Pat. Nos. 8,614,614 and 9,355,772, which are hereby incorporated by reference herein in their entirety for all purposes.

In accordance with a broad embodiment of the disclosure, a core-coil assembly (e.g., core-coil assembly 106) of a dry-type transformer is provided. Core coil assemblies 108 and 110 can be identical or substantially identical. The core-coil assembly 106 has an inner coil (e.g., low-voltage inner coil 212) with an inner surface 232 and an outer surface 234 and an outer coil 214 with an inner surface 236 and an outer surface 238. Each of the surfaces 232, 234, 236, 238 can be cylindrical at the location to be sealed, as will be further described herein.

The core-coil assembly 106 further includes the core assembly 102 including a core window 102W and core column 102L of a magnetically-permeable material. The core column 102L and the core window 102W have side surfaces 102S. The side surfaces 102S circumscribe the inner periphery of the core window 102W.

Figure 4A:
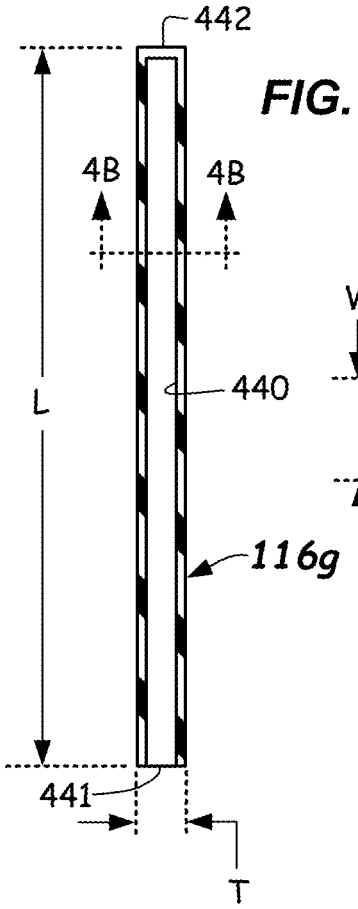
FIG. 4A illustrates a cross-sectioned side view of an embodiment of expandable sealing member in accordance with one or more embodiments provided herein.
Figure 4B:
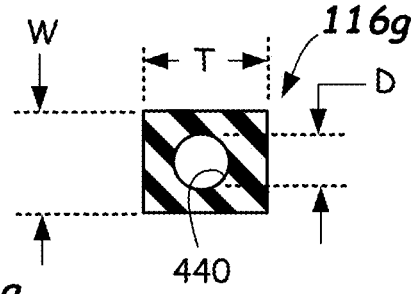
FIG. 4B illustrates an enlarged cross-sectioned end view of an embodiment of expandable sealing member taken along section line 4B-4B of FIG. 4A in accordance with one or more embodiments provided herein.

The core-coil assembly 106 further includes expandable sealing members 116*a*, 116*e*, 116*g*, and 116*h* and can include 116*c* when there are more than one coil assemblies (e.g., coil assemblies 106, 108) wherein each expandable sealing members 116*a*, 116*e*, 116*g*, 116*h*, and 116*c* includes an inner cavity 440 that is fillable or evacuatable. A first representative example of an expandable sealing member 116*g* is shown in FIGS. 4A and 4B. The expandable sealing member 116*g* can be made of a compliant material such as an elastomer material. Suitable elastomer materials include nitrile, fluorocarbon, ethylene propylene diene monomer rubber (EPDM), butadiene rubber, silicone, neoprene, fluorosilicone, hydrogenated nitrile butadiene rubber (HNBR), thermoplastic elastomer (TPE), and natural rubber. Other suitable flexible materials can be used. The expandable sealing member 116*g* can be molded in any suitable shape. For example, the expandable sealing member 116*g* shown in FIGS. 4A and 4B can include an open end 441 and a closed end 442 and can be injection, transfer or compression molded, for example. The expandable sealing member 116*g* includes suitable dimensions that enable sealing a respective gap between components of the transformer assembly 100.

In the case of the expandable sealing member 116*g*, the gap to be sealed is a gap between the core column 102L and the inner coil 112, wherein the gap extends along the length of the inner coil 112. In a first embodiment configured to be pressurized and expanded, the expandable sealing member 116*g* includes a thickness dimension T that is slightly less than the gap dimension of the gap to be sealed initially in a free state. Application of a pressure to cavity 440 will expand the dimension T and thus expand to seal the gap. The inner dimension D of the cavity 440 and width W of the expandable sealing member 116*g* are selected so that application of a suitable pressure can causes expansion of dimension T. A rectangular cross section is shown, but other cross-sectional shapes could be used. For example, one or more of the surfaces that seal can be formed to be non-planar, but instead can be actuate by including a cylindrical arc signet along the length L. In some embodiments, the side walls can be non-planar to allow for preferential expansion along the place of the core window 102W. The cavity 440 is shown as circular in cross-section, however, other cross=sectional shapes can be used.

In the depicted embodiment of FIGS. 3B-3C, a core-coil assembly 200 is shown. The core-coil assembly 200 includes a coil assembly (e.g., 106, 108, 110) each including multiple coils (e.g., inner coil 112 and outer coil 114), each of the multiple coils having an outer peripheral surface (including surfaces 232, 234, 244, and 246 for inner coil 212 and including surfaces 236, 238, 248, and 250 for outer coil 214). The core-coil assembly 200 further includes a core assembly 102 (FIG. 3A) including one or more core windows 102W formed therein. The core window 102W can be made up of two core columns (core columns 102L and 102C defining left and right sides of the left core window 102W and core columns 120C and 102R defining left and right sides of the right core window 102W) and at least two core legs (e.g., core legs 102T and 102B defining the top and bottom sides of the core windows 102W) all made of a magnetically-permeable material. The core windows 102W comprise inner side surfaces 102S defining an inner perimeter thereof.

Further, the core-coil assembly 200 includes expandable sealing members (e.g., 116*a*-116*n*) each including an inner cavity 440, that is fillable or evacuatable, inserted between the outer peripheral surfaces of the multiple coils (e.g., coils 212, 214) within the core window 102W and between the multiple coils (e.g., coils 212, 214) and the inner side surfaces 102S of the core window 102W.

As is best shown in FIGS. 3B-3C, the expandable sealing member 116*g* can be provided and seal between an inner side surface 102S of the core column 102L and an inner surface 232 of the inner coil 112. Likewise, expandable sealing members 116*j* and 116*k*, that can have a substantially same configuration as expandable sealing member 116*g*, can be provided to seal between the respective side surfaces 102S of the core column 102C and the inner surface 232 of the inner coil 112 in the plane 115 of the core window 102W. Expandable sealing member 116*n* can have a substantially same configuration as expandable sealing member 116*g* and can be provided to seal between a side surface 102S of the core column 102R and the inner surface 232 of the inner coil 112 in the plane 115 of the core window 102W.

Similarly, expandable sealing members 116*h*, 116*i*, 116*l*, and 116*m*, that can have a substantially same configuration as expandable sealing member 116*g*, can be provided to seal between an outside surface 234 of the inner coil 112 and the inside surface 236 of the outer coil 114 in the plane 115 of the core window 102W.

In another sealing area, expandable sealing members 116*c* and 116*d*, that can have a substantially same configuration as expandable sealing member 116*g*, can be provided to seal between outer surfaces 238 of the outer coils 114 in the plane 115 of the core window 102W.

Figure 4C:
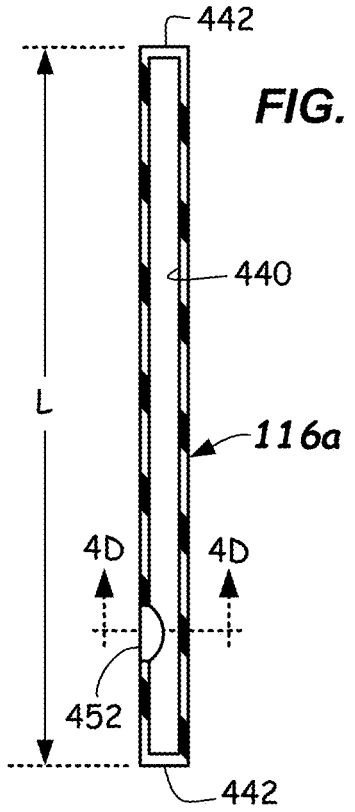
FIG. 4C illustrates a cross-sectioned side view of another embodiment of expandable sealing member having a side port in accordance with one or more embodiments provided herein.
Figure 4D:
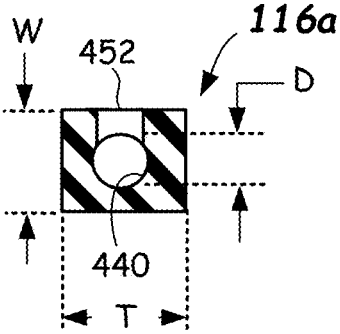
FIG. 4D illustrates an enlarged cross-sectioned end view of an embodiment of expandable sealing member taken along section line 4D-4D of FIG. 4C in accordance with one or more embodiments provided herein.
Figure 4E:
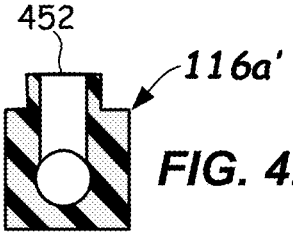
FIG. 4E illustrates an enlarged cross-sectioned end view of an embodiment of expandable sealing member including an extended side port in accordance with one or more embodiments provided herein.

In additional sealing areas above and below the inner coil 112 and outer coil 114, expandable sealing members 116*a*, 116*b* and 116*e*, 116*f*, that can have a configuration of expandable sealing member 116*a* shown in FIGS. 4C-4E, can be provided. The expandable sealing members 116*a*, 116*b*, 116*e*, 116*f* are configured to seal between respective inner side surfaces 102*s* of the core legs 102T, 102B forming core windows 102W and the upper surface 244 and lower surface 246 of the inner coil 112 and upper surface 248 and lower surface 250 of the outer coil 114 in the plane 115 of the core window 102W.

In the case of a single-phase transformer with only one core window, a primary core column surrounded by a core assembly, a return core column, and top and bottom core legs interconnecting the primary core column and the return core column, then an additional gap is sealed. In the single-phase transformer case, 1) the gap between inner and outer coils 212, 214, 2) the gaps between the inner coil 112 and the primary core column, 3) the gaps between the core legs and the top and bottom of the coil assembly, and additionally 4) the gap between the outer surface of the outer coil 214 and the inner side surface of the return column, all within the plane of the core window are sealed.

The expandable sealing member 116*a* includes some of the same features and construction as the previously-described expandable sealing member 116*g*. However, in this embodiment, the port at the open end 441 is eliminated and replaced with a closed end 442 and a side port 452 on a non-sealing side of the expandable sealing member 116*a* is provided. This embodiment of expandable sealing member 116*a* may be blow molded. Any suitable blow-moldable compliant material may be used, such as TPE. In some embodiments, the side port 452 may extend from a non-sealing side surface of the body of the expandable sealing member 116*a*' such as in FIG. 4E to allow ease of access and connection. Optionally, the expandable sealing member 116*a* may be formed by extruding and then cutting to the length L, cutting the side port 452, and filling the respective open ends 441 with a sealant or plugs.

As should be apparent, the two types of expandable sealing members 116*a*, 116*g* can take the form of an expandable tube having length L, width W, and thickness T. The as-molded or as extruded dimension of the thickness T can be configured to be less than the gap dimension G of the gap to be filled.

Figure 5A:
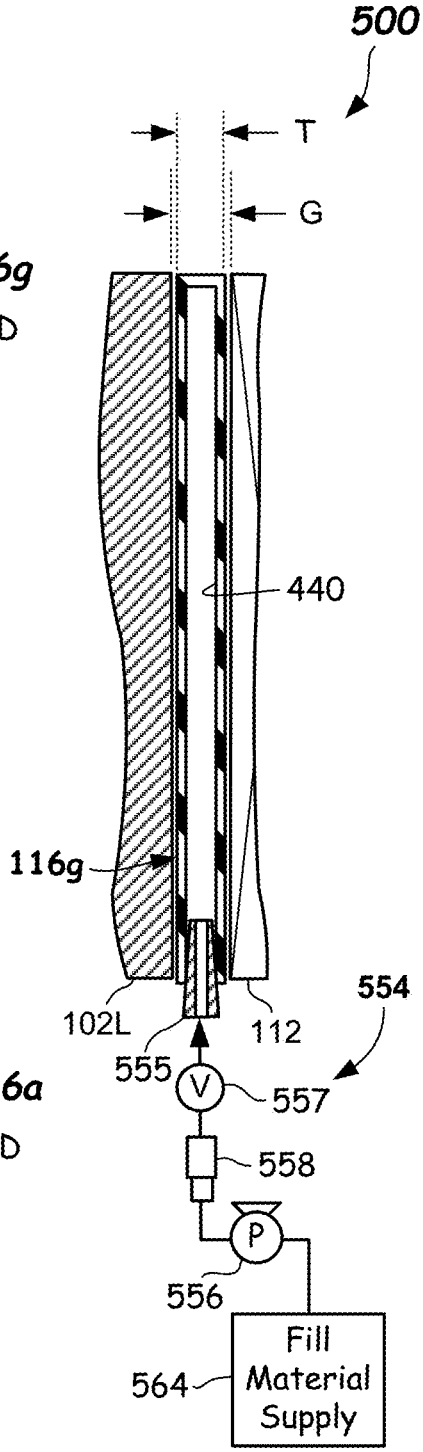
FIG. 5A illustrates a cross-sectioned side view of an embodiment of expandable sealing member having a fill apparatus coupled thereto and being shown in a non-expanded configuration in accordance with one or more embodiments provided herein.

FIG. 5A illustrates a sealing assembly 500 comprising core-coil assembly components to be sealed; the core-coil assembly components being provided in a spaced apart relationship defining a gap of dimension G. The core-coil assembly components to be sealed can be a core column such as the core column 102L of the core assembly 102 and the inner coil 112 shown.

Further, in some embodiments, the core-coil assembly components to be sealed may be the inner coil 112 and the outer coil 114 spaced apart to form a gap of dimension G. In some embodiments, the core-coil assembly components to be sealed may be an outer coil 114 of one coil assembly 108 and an outer coil 114 of another coil assembly (e.g., coil assembly 106 or 110) that are spaced apart to form a gap of dimension G. In another embodiment, the core-coil assembly components to be sealed may be the inner coil 112 and the outer coil 114 and the core assembly 102 wherein top surfaces 244, 248 of inner coil 112 and the outer coil 114 are spaced apart from side surfaces 102S of the top core leg 102T above the top surfaces 244, 248 to form a gap of dimension G. Likewise, in another embodiment, the core-coil assembly components to be sealed may be the inner coil 112 and the outer coil 114 of the core assembly 102 wherein bottom surfaces 246, 250 of inner coil 112 and the outer coil 114 are spaced apart from side surfaces 102S of the bottom core leg 102B of the core assembly 102 below the bottom surfaces 246, 250 to form a gap of dimension G.

Further, the sealing assembly 500 includes an expandable sealing member 116*g* occupying the gap, the expandable sealing member 116*a* including an inner cavity 440 in all embodiments. Other gaps to be filled are filled by expandable sealing members 116*a*-116*f* and 116*h*-116*m*.

Additionally, the sealing assembly 500 can include an expander/contractor apparatus 554 comprising a port connector 555 coupled to the cavity 440, such as by sealing to a port. The port connector 555 can be a nipple of any suitable size and shape to accomplish a sealed connection. For example, an outer shape of the port connector 555 may include a conical taper thereon or other suitable shape such that forceful insertion into the port seals the port around the outside of the port connector 555. Optionally, the expander/contractor apparatus 554 can include a valve 557 and a quick disconnect coupling 558 such that the pump 556 can be removed and used with another expandable sealing member for sealing another gap.

Figure 5B:
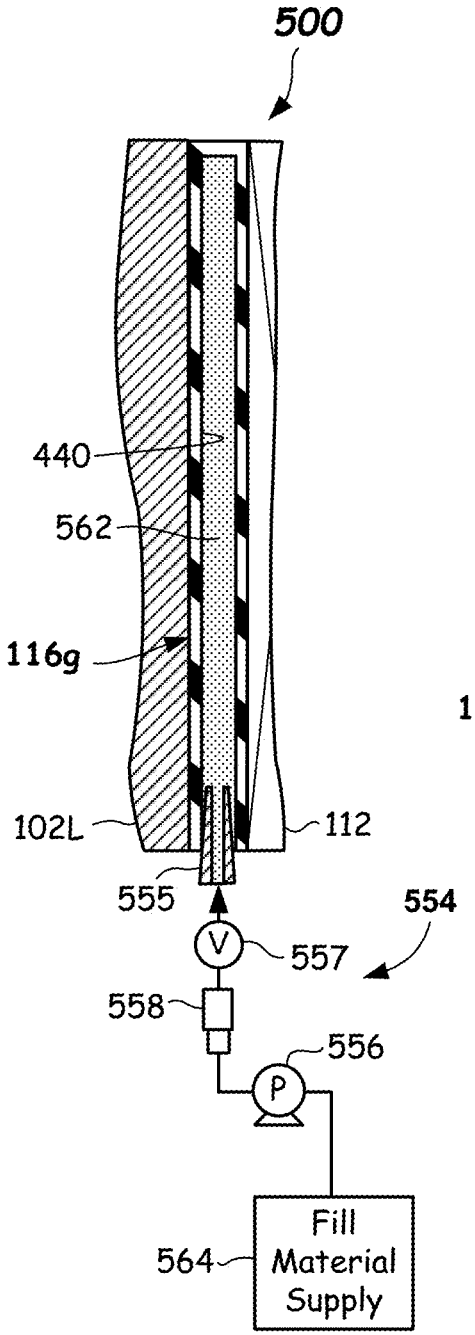
FIG. 5B illustrates a cross-sectioned side view of an embodiment of expandable sealing member having a fill apparatus coupled thereto and being shown in an expanded and filled configuration in accordance with one or more embodiments provided herein.
Figure 5C:
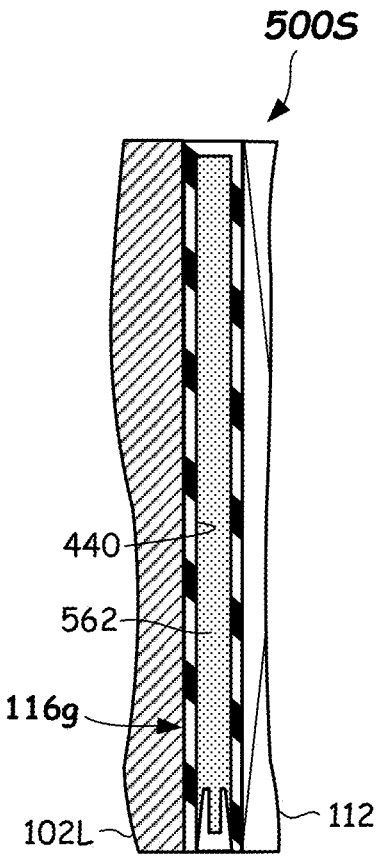
FIG. 5C illustrates a cross-sectioned side view of an embodiment of expandable sealing member having the fill apparatus decoupled and being shown in an expanded, filled and cured configuration in accordance with one or more embodiments provided herein.

The sealing assembly 500 can include optional components for achieving the expansion of the expandable sealing member. In some embodiments, a positive pressure pump 556 (FIG. 5A) is provided. In other embodiments, a vacuum pump 660 (see FIGS. 6A-6B). Referring to FIGS. 5A-5C, the positive pressure pump 556 is configured to pump a fill material 562 from a fill material supply 564 into the cavity 440 via application of positive pressure. The fill material supply 564 is interconnected to the port connector 555 through valve 557.

This positive pressure from positive pressure pump 556 operates to expand and flex the expandable sealing member 116*g* in thickness having an unexpanded (as-molded) dimension T1 into the gap of dimension G and thus seal the gap as shown in FIG. 5B. The fill material 562 may then be cured into a suitable solid or semi-solid material. For example, the fill material 562 may be any material that when cured under pressure will retain a sealing force against the surfaces of the core-coil components being sealed. For example, the fill material 562 may be a curable polymer such as a curable silicone material. For example, the fill material 562 may be a room temperature curable two-part silicone, such as ELASTOSIL® RT available from Wacker Chemie AG of Munchen, Germany, and the like. After curing the port connector 555 can be removed and a sealed core-coil assembly 500S is the result.

In the other case, the sealing assembly 600, 700 can include a vacuum pump 660 as shown in FIG. 6 and FIGS. 7A-7G. The vacuum pump 660 is configured to evacuate and contract the cavity 440 of the expandable sealing member 116*g*', and thereafter release the vacuum and expand the expandable sealing member 116*g*' into the gap of dimension G. Thus, in this embodiment, the initial (as-molded) dimension T of the expandable sealing member 116*g*' is formed to be greater than the gap dimension G initially. The evacuation reduces the thickness T to a value T1 less than dimension G such that the expandable sealing member 116*g*' can easily be inserted into the gap and position adjusted therein. Once properly positioned in the plane of the core window 102W, the vacuum can be released and the expandable sealing member 116*g*' can flex and expand due to its inherent stored energy and is sealed to the gap of dimension G.

Figure 6:
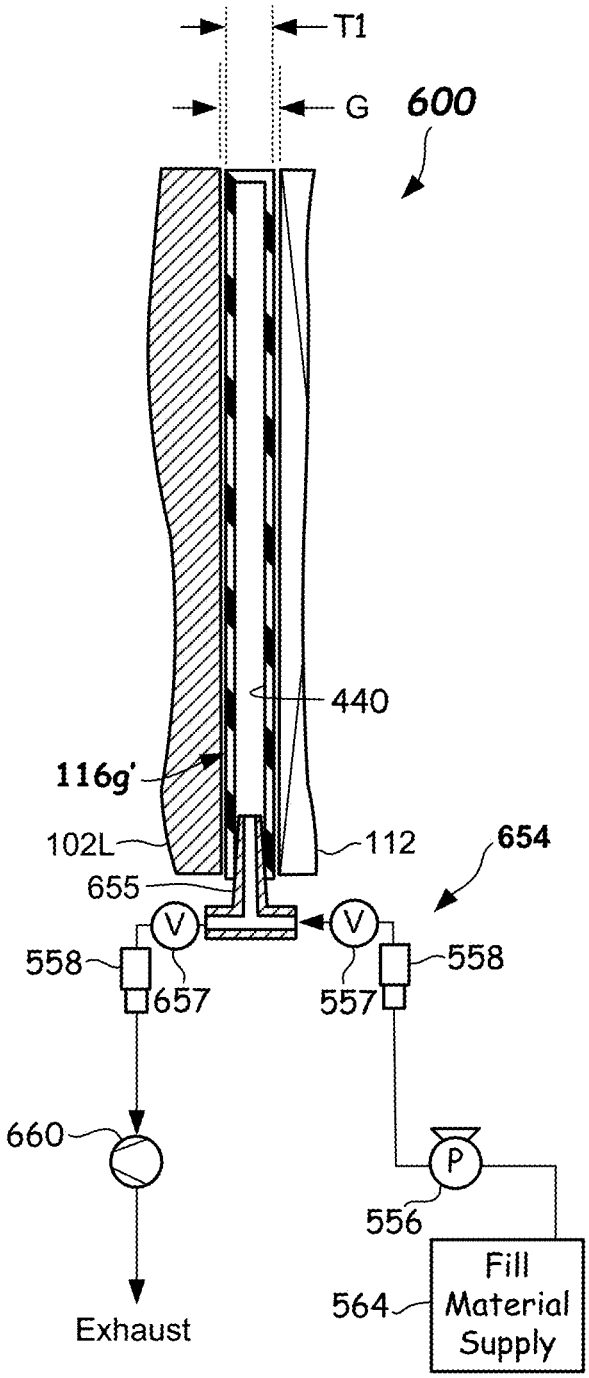
FIG. 6 illustrates a cross-sectioned side view of an embodiment of an expandable sealing member having an evacuation and fill apparatus coupled thereto and being shown in a contracted configuration prior to fill in accordance with one or more embodiments provided herein.

As can be seen in FIG. 6, the sealing assembly 600 can includes an expander/contractor apparatus 654 including a vacuum pump 660, a valve 657, and a port connector 655 configured to evacuate and contract the cavity 440 of the expandable sealing member 116*g*'. Port connector 655 can comprise a T-connector coupled to the open end. Expander/contractor apparatus 654 can also include a fill assembly including a positive pressure pump 556, valve 557, and a fill material supply 564.

Upon evacuation of cavity 440 and contraction of thickness T to thickness T1 via operation of vacuum pump 660, valve 657 is closed. Valve 557 is then opened and positive pressure pump 556 operated to provide a fill material (not shown in FIG. 6) to fill the cavity 440, which may be filled under pressure to allow better sealing. Quick disconnect couplings 558 may be used to decouple the vacuum pump 660 and the positive pressure pump 556 so they can be used on another gap fill operation at a different location. Like before, the valves 557, 657 interconnected to the port connector 655 are both configured to be in a closed orientation after flowing a fill material into the cavity 440. The fill material may then be cured in place.

FIG. 7 illustrates an embodiment wherein the expander/contractor apparatus 754 comprises a port connector 755, an integral valve 757 interconnected to a vacuum pump 660. In this embodiment, after being evacuated by the expander/contractor apparatus 754 such that the thickness T is reduced to T1 dimension smaller than the gap dimension G, the vacuum may be removed/shut off and the expandable sealing member 116*g*' allowed to expand to seal the gap. In some embodiments, such as shown in FIG. 7B, the vacuum pump 660 may be disconnected by using a quick disconnect coupling 558. Following this the valve 757 can be opened to expand the expandable sealing member 116*g*'.

Thus, it should be apparent that according to some embodiments, a sealing assembly (e.g., sealing assembly 500, 600, 700) is provided. The sealing assembly includes core-coil assembly components (e.g., one or more coils 212, 214 and core assembly 102) provided in a spaced relationship defining a gap (e.g., having a gap dimension G); an expandable sealing member (e.g., one of expandable sealing members 116*a*-116*n*) occupying the gap, the expandable sealing member including a cavity 440. The sealing assembly (e.g., sealing assembly 500, 600, 700) further including an expander/contractor apparatus (e.g., expander/contractor apparatus 554, 654, 754) comprising a port connector (e.g., 555, 655, 755) coupled to the cavity 440, and either:

a pump (e.g., positive pressure pump 556) configured to pump a fill material (e.g., fill material 562) into the cavity 440 and expand the expandable sealing member into the gap, or a vacuum (e.g., vacuum pump 660) configured to evacuate the cavity 440, when thereafter the vacuum is released to expand the expandable sealing member into the gap.

Figure 7A:
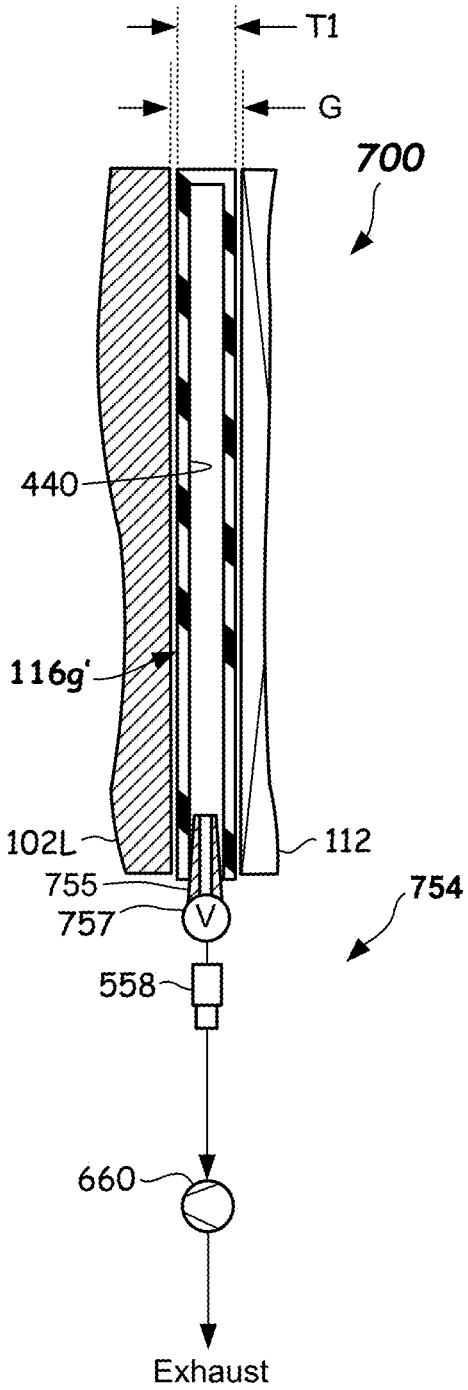
FIG. 7A illustrates a cross-sectioned side view of an embodiment of expandable sealing member having an evacuation apparatus including a vacuum pump coupled thereto and being shown in a contracted configuration in accordance with one or more embodiments provided herein.
Figure 7B:
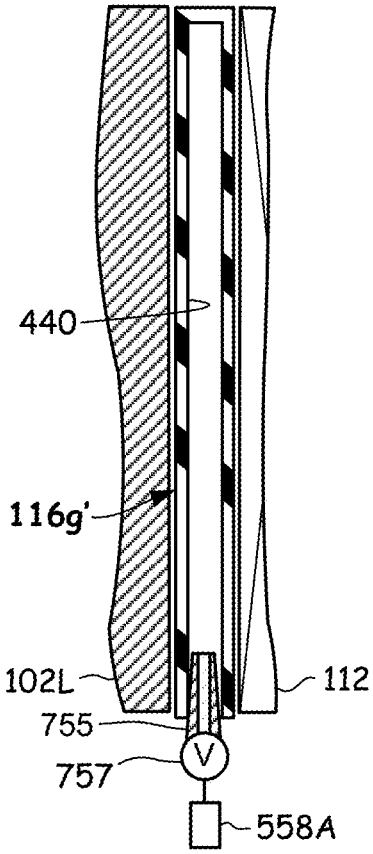
FIG. 7B illustrates a cross-sectioned side view of an embodiment of expandable sealing member shown in an contracted configuration (under vacuum) and decoupled from the vacuum pump in accordance with one or more embodiments provided herein.
Figure 7C:
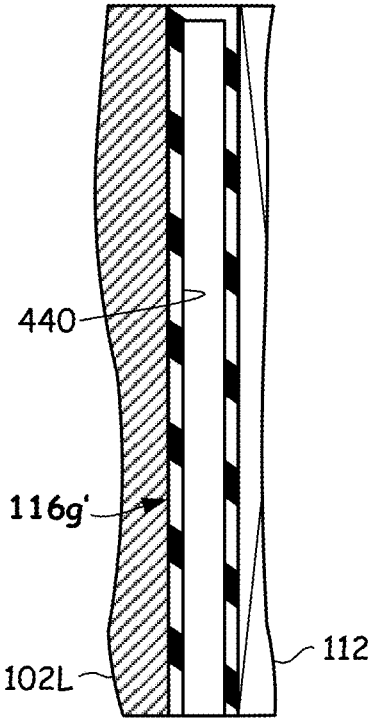
FIG. 7C illustrates a cross-sectioned side view of an embodiment of expandable sealing member shown in an expanded configuration (upon release of the vacuum) and decoupled from the evacuation apparatus in accordance with one or more embodiments provided herein.
Figure 7D:
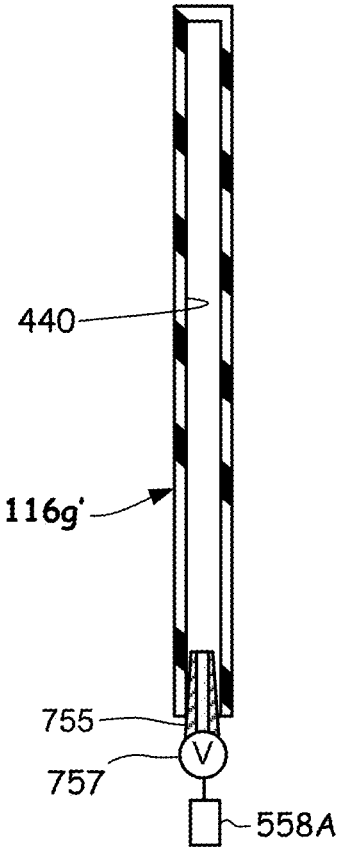
FIG. 7D illustrates a cross-sectioned side view of an embodiment of expandable sealing member having the vacuum pump of the evacuation apparatus decoupled therefrom and being shown in a contracted (non-expanded) configuration wherein the contraction and removal of the vacuum pump can occur remotely from the location where the expandable sealing member is used for sealing in accordance with one or more embodiments provided herein.
Figure 7E:
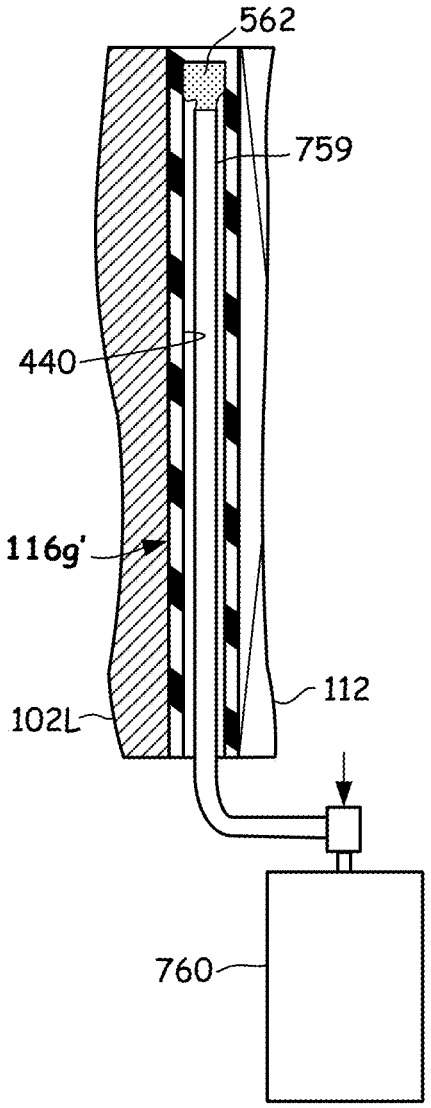
FIG. 7E illustrates a cross-sectioned side view of an embodiment of expandable sealing member shown in an expanded configuration and with the cavity being filled with a filler material in accordance with one or more embodiments provided herein.

As can be seen in FIG. 7D, in some embodiments, the expandable sealing member 116*g*' can be evacuated by a vacuum pump 660 at a common location remote from the gap, the valve 757 closed and the quick disconnect coupling 558 disconnected to leave only half 558A of the coupling quick disconnect coupling 558. Thus, the expandable sealing member 116*g*' is now mobile and can be moved into place as desired to seal the gap.

Figure 7F:
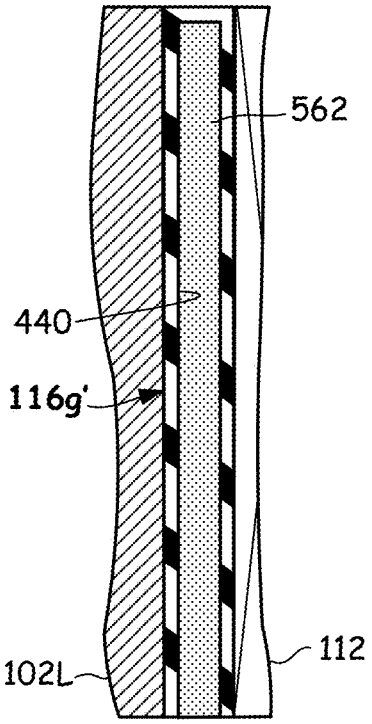
FIG. 7F illustrates a cross-sectioned side view of an embodiment of expandable sealing member shown in an expanded and filled configuration in accordance with one or more embodiments provided herein.
Figure 7G:
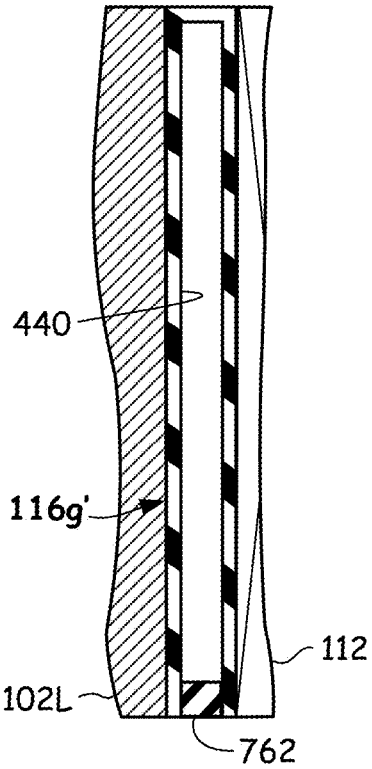
FIG. 7G illustrates a cross-sectioned side view of an embodiment of expandable sealing member shown in an expanded and plugged configuration in accordance with one or more embodiments provided herein.

In some embodiments, the cavity 440 can remain unfilled. Optionally, the cavity 440 can be filled with a filler material 562 by inserting a fill implement 759(e.g., tube) into the cavity 440 and filling from a canister 760 of fill material 562. The fill implement 759 can be backed out of the cavity 440 as filling is commenced. The end-filled expandable sealing member 116*g*' is shown in FIG. 7F filling and sealing the gap. As another option, the end of the expandable sealing member 116*g*' can be plugged with a plug 762 comprising a compliant plug member or a plug of a sealant material (e.g., silicone). Other suitable plugging techniques may be used.

Various configurations and manufacturing methods can be used for the expandable sealing members 116*a*-116*n* and 116*g*'. For example, cross-sectional shapes other than rectangular can be used.

Figure 8A:
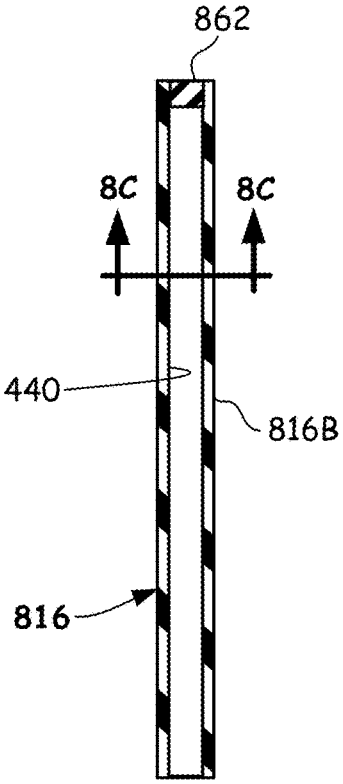
FIG. 8A illustrates a cross-sectioned side view of an embodiment of expandable sealing member that is extruded and then end plugged in accordance with one or more embodiments provided herein.
Figure 8B:
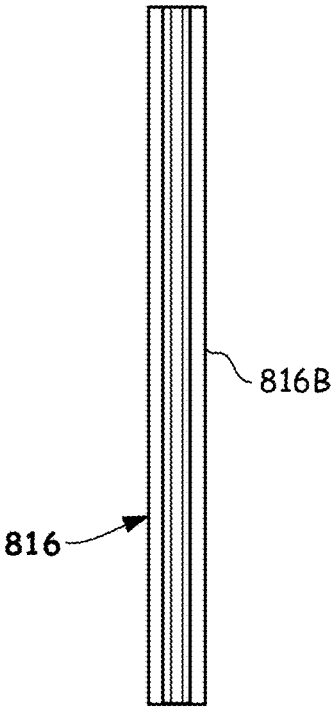
FIG. 8B illustrates a side plan view the expandable sealing member of FIG. 8A in accordance with one or more embodiments provided herein.
Figure 8C:
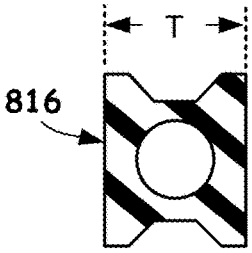
FIG. 8C illustrates an enlarged cross-sectioned end view of the expandable sealing member of FIG. 8A taken along section line 8C-8C and showing a non-rectangular cross-sectional shape that can be preferentially contracted in one direction in accordance with one or more embodiments provided herein.
Figure 8D:
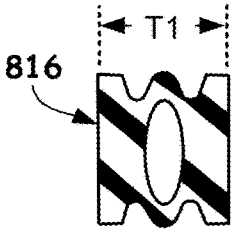
FIG. 8D illustrates an enlarged cross-sectioned end view of the expandable sealing member of FIG. 8A-8C illustrating preferential contraction in one direction in accordance with one or more embodiments provided herein.

As shown in FIG. 8A-8D an embodiment of expandable sealing member 816 is shown that includes a non-rectangular cross section, and an extruded and plugged configuration. The expandable sealing member 816 can be used for any of the expandable sealing members 116*a*-116*n* and 116*g*' that are vertically oriented. As shown, the expandable sealing member 816 includes an extruded body 816B formed by extruding the compliant material (e.g., a TPE) and installing an end plug 862 therein. End plug 862 can be as described above. The expandable sealing member 816 includes recessed sides that allow the expandable sealing member 816 to expand and/or contract preferentially in the thickness direction upon application of pressure or vacuum. For example, a contracted configuration is shown in FIG. 8D wherein application of a vacuum contracts the thickness to a T1 dimension that is less than T. In some embodiments, the port connector (e.g., port connector 755 may include an elongated configuration rather than a cone to allow each of contraction.

Figure 9A:
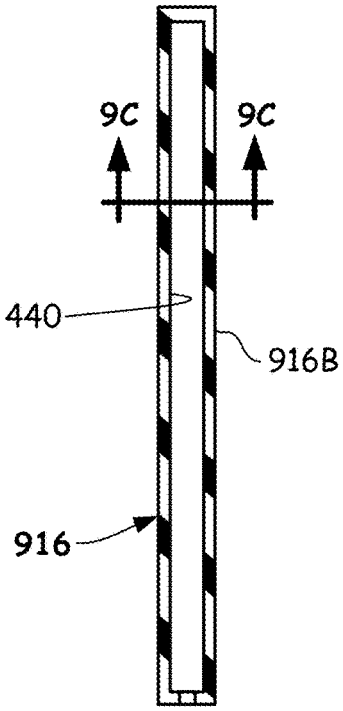
FIG. 9A illustrates a cross-sectioned side view of an embodiment of expandable sealing member that is blow molded in accordance with one or more embodiments provided herein.
Figure 9B:
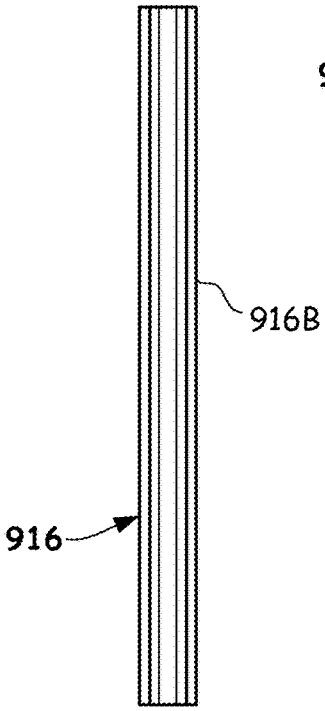
FIG. 9B illustrates a side plan view the expandable sealing member of FIG. 9A in accordance with one or more embodiments provided herein.
Figure 9C:
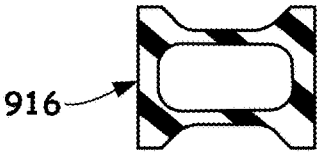
FIG. 9C illustrates a cross-sectioned end view of the expandable sealing member taken along section line 9C-9C of FIG. 9A and showing another non-rectangular shape that can be preferentially contracted in one direction in accordance with one or more embodiments provided herein.
Figure 9D:
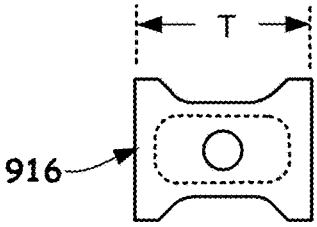
FIG. 9D illustrates an end view of the expandable sealing member of FIG. 9A-9C in accordance with one or more embodiments provided herein.
Figure 9E:
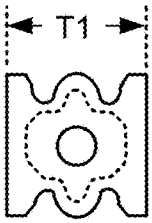
FIG. 9E illustrates an end view of the expandable sealing member of FIGS. 9A-9D shown preferentially contracted in one direction in accordance with one or more embodiments provided herein.
Figure 10:
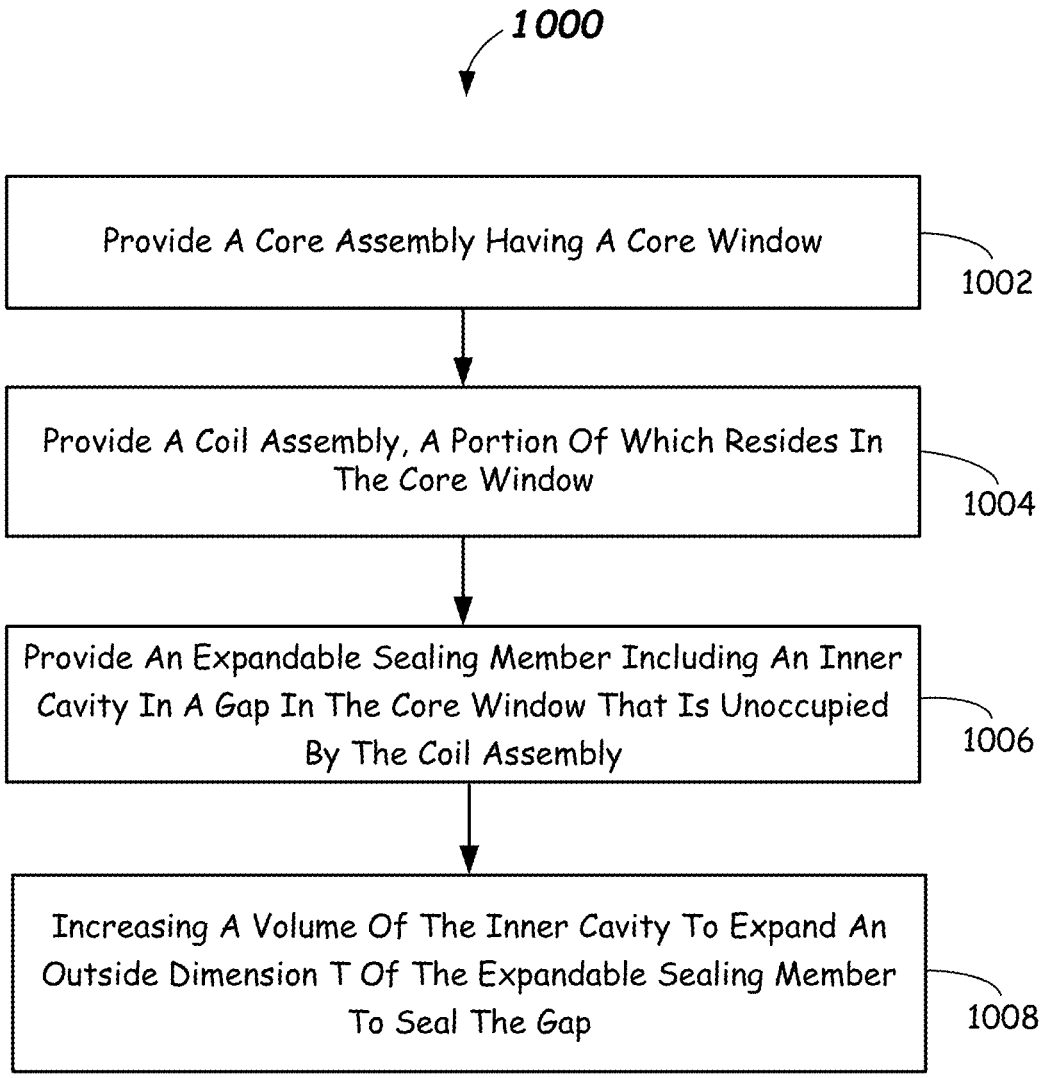
FIG. 10 illustrates a flowchart of a method of sealing a core-coil assembly in accordance with one or more embodiments provided herein.

As shown in FIG. 9A-9D an embodiment of expandable sealing member 916 is shown that includes a non-rectangular cross section, and a blow-molded configuration. The expandable sealing member 916 can be used for any of the expandable sealing members 116*a*-116*m* and 116*g*' that are vertically oriented. As shown, the expandable sealing member 916 includes a blow molded body 916B formed by blow molding a compliant material (e.g., a TPE) in a mold to form the complex body 916B and port therein. Other cross sectional shapes are possible, but thinner side walls allow for preferential direction of contraction as shown in FIG. 9E.

Other configurations can be implemented wherein the port is provided on a non-sealing side of the expandable sealing member. For example, the fill port can be cut on a non-sealing side of the extruded body 816B and the other end can also be plugged. In an alternative to the expandable sealing member 916, the port can be blow molded on a side, such as shown in FIGS. 4C-4E. In some embodiments, the expandable sealing members can include a sealant on the sealing end faces to aid in making a permanent seal and minimizing movement of the expandable sealing member in the gap. Other suitable configurations of the expandable sealing member are possible provided they can be expanded or contracted, or both.

In a broad aspect, a core-coil assembly 100 is provided. The core-coil assembly 100 includes a coil assembly including multiple coils (e.g., inner coils 112 which can be low voltage coils and outer coils 114 that can be high-voltage outer coils), each of the multiple coils having an outer peripheral surface (made up of the inner surface, outer surface, upper surface, and lower surface). The core-coil assembly 100 further includes a core assembly 102 including one or more core windows 102W and at least one core column of a magnetically-permeable material, the core window 102 having inner side surfaces. In practice, a return path for the magnetic circuit is used, and is usually another core column. In the depicted embodiment, three core columns (core columns 102L, 102C, 102R) are included. In the single phase transformer case, only two core columns can be used.

The core-coil assembly 100 includes expandable sealing members (e.g., like expandable sealing members 116*a*-116*n*, and 116*g*'). At least some, and preferably each of the expandable sealing members (e.g., expandable sealing members 116*a*-116*n* and 116*g*') include a cavity 440 that is fillable or evacuatable. The expandable sealing members are inserted between the outer peripheral surfaces of the multiple coils (e.g., between inner coil 112 and outer coil 114) within the core window 102W and between the multiple coils and the inner side surfaces 102S of the core window 102W (e.g., between ends of inner and outer coils 112, 114 and the top and bottom core legs 102T, 102B, and between the inner coils 112 and the core column (e.g., core column 102L, 102C, 102R).

In some embodiments, a method 1000 is provided for sealing a gap between components of a core-coil assembly 200, such as in a dry-type transformer. The method 1000 includes, in 1002, providing a core assembly (e.g., core assembly 102) having a core window (e.g., core window 102W and in some embodiments, multiple core windows 102W), and in 1004, providing a coil assembly (e.g., coil assembly 106, 108, and/or 110), a portion of which, resides in the core window 102W. The method 100 further includes, in 1006, providing an expandable sealing member (e.g., in practice multiple expandable sealing members 116*a*-116*n*, 116*g*') including an inner cavity (e.g., inner cavity 440) in a gap (of dimension G) in the core window 102W that is unoccupied by the coil assembly. The method 1000 further includes, in 1008, increasing a volume of the inner cavity 440 to expand an outside dimension (T or T1) of the expandable sealing member to seal the gap. In one embodiment, the dimension (T) is expanded by increasing the pressure in the cavity 440 during a fill operation to fill the gap of dimension G. In another embodiment, increasing the volume of the inner cavity 440 to expand an outside dimension (T1) of the expandable sealing member comprises releasing a vacuum in the inner cavity 440 thereby expanding the dimension to fill the gap of dimension G.

While the present disclosure is described primarily with regard to submersible 3-phase dry-type transformers, it will be understood that the disclosed expandable sealing members and assemblies may also be employed with other types of transformers (e.g., single-phase transformers) or coil assemblies.

The foregoing description discloses only example embodiments. Modifications of the above-disclosed apparatus, assemblies, and methods which fall within the scope of this disclosure will be readily apparent to those of ordinary skill in the art. For example, although the examples discussed above are illustrated for dry-type transformers, other embodiments in accordance with this disclosure can be implemented for other devices. This disclosure is not intended to limit the invention to the particular apparatus, assemblies and/or methods disclosed, but, to the contrary, the intention is to cover all modifications, equivalents, and alternatives falling within the scope of the claims.

What is claimed is:

1. A core-coil assembly of a dry-type transformer submersible in a body of water, comprising:

a coil assembly having an inner coil with an inner surface, an outer surface, an upper surface, and a lower surface, and an outer coil with an inner surface, an outer surface, an upper surface, and a lower surface;

a core assembly including a core window and a core column of a magnetically-permeable material, the core column and the core window having inner side surfaces; and an expandable sealing member including an inner cavity that is fillable or evacuatable, the expandable sealing member positioned between:

one or more inner side surfaces of the core column and an inner surface of the inner coil, the outer surface of the inner coil and the inner surface of the outer coil, and between the upper surface and lower surface of the inner coil and the outer coil and the inner side surfaces of the core window, the inner cavity of the expandable sealing member filled with a compliant solid insulation material to seal a gap between the surfaces where the expandable sealing member is positioned, so that during submerged operation of the dry-type transformer formation of an electrically conductive loop of water is inhibited in the sealed gap between the surfaces where the expandable sealing member is positioned.

2. The core-coil assembly of claim 1, wherein the expandable sealing member comprises an expandable tube.

3. The core-coil assembly of claim 1, wherein the expandable sealing member comprises an open end and a closed end.

4. The core-coil assembly of claim 1, wherein the cavity is filled with a curable polymer.

5. The core-coil assembly of claim 4, wherein the curable polymer comprises silicone.

6. The core-coil assembly of claim 1, comprising a T-connector coupled to the open end.

7. The core-coil assembly of claim 1, wherein the expandable sealing member including the cavity is provided between the inner side surface of the core column and the inner surface of the inner coil.

8. The core-coil assembly of claim 1, wherein the expandable sealing member including the cavity is provided between the outer surface of the inner coil and the inner surface of the outer coil.

9. The core-coil assembly of claim 1 wherein the expandable sealing member including the cavity is provided between the top surfaces of the inner coil and outer coil and the inner side surface of the core window.

10. The core-coil assembly of claim 1 wherein the expandable sealing member including the cavity is provided between the bottom surfaces of the inner coil and the outer coil and the inner side surface of the core window.

11. The core-coil assembly of claim 1 wherein the expandable sealing member including the cavity is provided between the outer surface of the outer coil and an outer surface of another outer coil.

12. The core-coil assembly of claim 1 wherein the expandable sealing member including the cavity is provided to seal between inner side surfaces of a second core window of the core assembly and surfaces of a second coil assembly and also between surfaces of the second coil assembly.

13. A core-coil assembly of a dry-type transformer submersible in a body of water, the core-coil assembly comprising:

a coil assembly including multiple coils, each of the multiple coils having outer peripheral surfaces;

a core assembly including a core window and at least one core column of a magnetically-permeable material, the core window having inner side surfaces; and expandable sealing members each including an inner cavity that is fillable or evacuatable, the expandable sealing members inserted between:

the outer peripheral surfaces of the multiple coils within the core window, and the multiple coils and the inner side surfaces of the core window, the inner cavity of each of the expandable sealing members filled with a compliant solid insulation material to seal a gap between the surfaces where the expandable sealing member is positioned, so that during submerged operation of the dry-type transformer formation of an electrically conductive loop of water is inhibited in the sealed gap between the surfaces where the expandable sealing members are inserted.

14. A core-coil assembly of a dry-type transformer submersible in a body of water, the core-coil assembly comprising:

a core column;

a first coil received about the core column and forming a gap; and an expandable sealing member including a cavity sealing the gap between the core column and the first coil the inner cavity of the expandable sealing member filled with a compliant solid insulation material so that during submerged operation of the dry-type transformer formation of an electrically conductive loop of water is inhibited in the sealed gap.

15. The core-coil assembly of claim 14 wherein the expandable sealing member is expandable by application of a pressure to the cavity or contractible by application of vacuum to the cavity.

16. The core-coil assembly of claim 14 further comprising a second coil surrounding the first coil and providing another gap between the first coil and the second coil, and another expandable sealing member including a cavity sealing the gap between the first coil and the second coil.

17. The core-coil assembly of claim 16 further comprising another expandable sealing member provided between the inner side surface of a core window and an end surface of the first coil and the second coil, the expandable sealing member including an inner cavity.

18. A core-coil assembly of a dry-type transformer submersible in a body of water, the core-coil assembly comprising:

a core assembly of a magnetically-permeable material having a core window with an inner side surface;

a coil assembly, a portion of which resides in the core window, the coil assembly including an end surface; and an expandable sealing member positioned between the inner side surface of the core window and the end surface of the coil assembly the expandable sealing member including an inner cavity, the inner cavity of the expandable sealing member filled with a compliant solid insulation material to seal a gap between the surfaces where the expandable sealing member is positioned so that during submerged operation of the dry-type transformer formation of an electrically conductive loop of water is inhibited in the sealed gap between the surfaces where the expandable sealing member is positioned.

* * * * *